US010206514B1

(12) United States Patent
Zivalich

(10) Patent No.: US 10,206,514 B1
(45) Date of Patent: Feb. 19, 2019

(54) CONTOURED MEDITATION SEAT

(71) Applicant: Keith Lawrence Zivalich, Valencia, CA (US)

(72) Inventor: Keith Lawrence Zivalich, Valencia, CA (US)

( * ) Notice: Subject to any disclaimer, the term of this patent is extended or adjusted under 35 U.S.C. 154(b) by 0 days.

(21) Appl. No.: 15/705,652

(22) Filed: Sep. 15, 2017

Related U.S. Application Data

(60) Provisional application No. 62/430,535, filed on Dec. 6, 2016.

(51) Int. Cl.

| | |
|---|---|
| ***A47C 9/00*** | (2006.01) |
| ***A47C 7/50*** | (2006.01) |
| ***A47C 7/40*** | (2006.01) |
| ***A47C 3/16*** | (2006.01) |

(52) U.S. Cl.
CPC ..... *A47C 9/002* (2013.01); *A47C 3/16* (2013.01); *A47C 7/40* (2013.01); *A47C 7/50* (2013.01)

(58) Field of Classification Search
CPC .. A47C 9/002; A47C 9/00; A47C 3/16; A47C 7/40; A47C 7/50; A47C 7/36; A47C 7/38
USPC ..... 297/445.1
See application file for complete search history.

(56) References Cited

U.S. PATENT DOCUMENTS

| | | | | |
|---|---|---|---|---|
| 4,027,888 | A * | 6/1977 | Wilcox | A47C 3/16 297/284.1 |
| 4,902,003 | A * | 2/1990 | Buoni | A63B 23/0211 297/258.1 |
| D348,491 | S * | 7/1994 | Diep | D21/690 |
| D418,563 | S * | 1/2000 | Hwang | D21/688 |
| 8,671,484 | B1 * | 3/2014 | Logiodice | A47D 15/005 5/655 |
| 8,734,157 | B1 * | 5/2014 | Hummel, III | A63F 13/00 434/247 |
| 9,420,890 | B2 * | 8/2016 | Lee | A47C 5/12 |
| D785,960 | S * | 5/2017 | Davis | D6/361 |
| D817,653 | S * | 5/2018 | Lee | D6/361 |
| 2017/0318970 | A1 * | 11/2017 | Roizner | A47C 3/16 |

* cited by examiner

*Primary Examiner* — Mark R Wendell
(74) *Attorney, Agent, or Firm* — Plager Schack LLP; Mark H. Plager; Michael J. O'Brien

(57) ABSTRACT

A contoured meditation seat is adapted to elevate a human user's feet while arching the human user's back. The contoured meditation seat includes a base joined to a first end side and a second end side. A head end side is joined to the base, the first end side, and the second end side. A foot end side is joined to the base, the first end side, and the second end side. The foot end side further comprises a concave portion elevated above the head end side. A platform is arranged between the first end side, the second end side, the head end side and the foot end side. The platform is adapted to accommodate the human user such that feet of the human user are adjacent to the foot end side and a head of the human user is against the head end side.

8 Claims, 4 Drawing Sheets

CONTOURED MEDITATION SEAT

RELATED APPLICATION

This application claims priority to provisional patent application U.S. Ser. No. 62/430,535 filed on Dec. 6, 2016, the entire contents of which is herein incorporated by reference.

BACKGROUND

The embodiments herein relate generally to furniture.

Prior to embodiments of the disclosed invention mediation seats were designed to support users who sit in the Lotus position at a 90-degree angle with straight backs and crossed legs. This placed compressive weight from the upper body directly down onto the spine, as well as causing joint pressure on the knees and reducing blood circulation to the legs. This resulted in increased neck, back and lower lumbar fatigue as well as swelling in the legs. Embodiments of the disclosed invention solve this problem.

Some other endeavors in this field include: U.S. Pat. No. 5,141,285 issued to Park; U.S. Pat. No. 4,027,888 issued to Wilcox; and U.S. Pat. No. 9,456,696 issued to Lee. Park teaches a relaxation chair that is built about a user in a predetermined position. However, the user's feet are too low. Wilcox teaches a variable contour seating device filled with polystyrene beads that accommodate a user's back, but again, the foot portion is too low. Lee uses a convex footrest instead of a concave footrest.

SUMMARY

A contoured meditation seat is adapted to elevate a human user's feet while arching the human user's back. The contoured meditation seat includes a base joined to a first end side and a second end side. A head end side is joined to the base, the first end side, and the second end side. A foot end side is joined to the base, the first end side, and the second end side. The foot end side further comprises a concave portion elevated above the head end side. A platform is arranged between the first end side, the second end side, the head end side and the foot end side. The platform is adapted to accommodate the human user such that feet of the human user are adjacent to the foot end side and a head of the human user is against the head end side.

In some embodiments, the base can include a base first edge joined to base second edge. A base third edge can be joined to the base second edge. A base fourth edge can be joined to the base third edge. The base can be approximately rectangular.

In some embodiments, the first side can include a first side first edge and a first side second edge that can be joined to the base first edge. A first side first top edge can be joined to the first side first edge. A first side third edge can be joined to the first side first top edge. A first side platform edge can be joined to the first side third edge. A first side fourth edge can be joined to the first side platform edge. A first side second top edge can be joined to the first side fourth edge and the first side second edge.

In some embodiments, the second side can include a second side first edge and a second side second edge that can be joined to the base first edge. A second side first top edge can be joined to the second side first edge. A second side third edge can be joined to the second side first top edge. A second side platform edge can be joined to the second side third edge. A second side fourth edge can be joined to the second side platform edge. A second side second top edge can be joined to the second side fourth edge and the second side second edge.

In some embodiments, the foot end side can further include a foot end first sloping section that can be joined to the second side second edge and terminating at a foot end sloping end point. A foot end second sloping section can be joined to the first side first edge and terminating at the foot end sloping end point. The foot end sloping end point can be vertically offset from the base second edge by a foot end distance.

In some embodiments, the head end side can further include a head end first sloping section, joined to the first side second edge and terminating at a head end sloping end point. A head end second sloping section can be joined to the second side first edge and terminating at the head end sloping end point. The head end sloping end point is vertically offset from the base fourth edge by a head end distance.

In some embodiments, the platform portion can further include an outer perimeter defined by the foot end second sloping section that can be joined to the second side second top edge. The first side first top edge can be joined to the foot end first sloping section. The first side second top edge can be joined to the head end first sloping section. The second side first top edge can be joined to the head end second sloping section.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
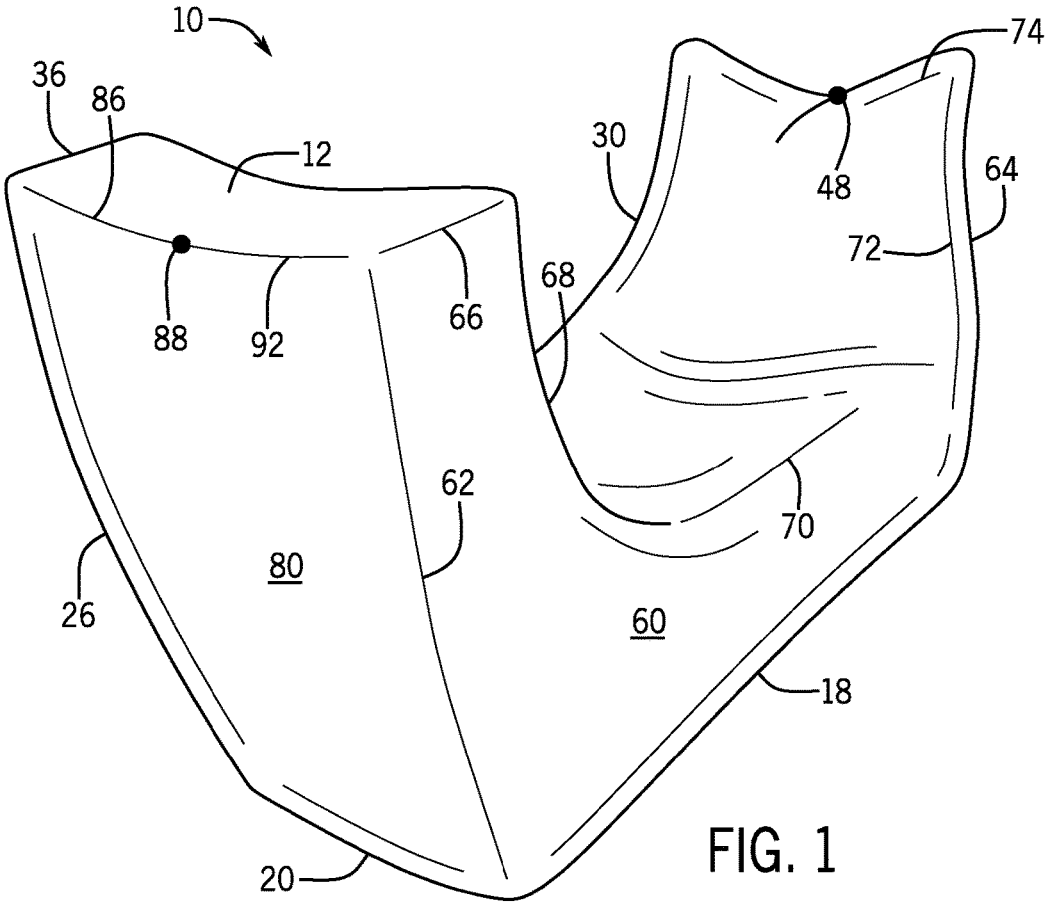
FIG. 1 shows a perspective view of one embodiment of the present invention.
Figure 2:
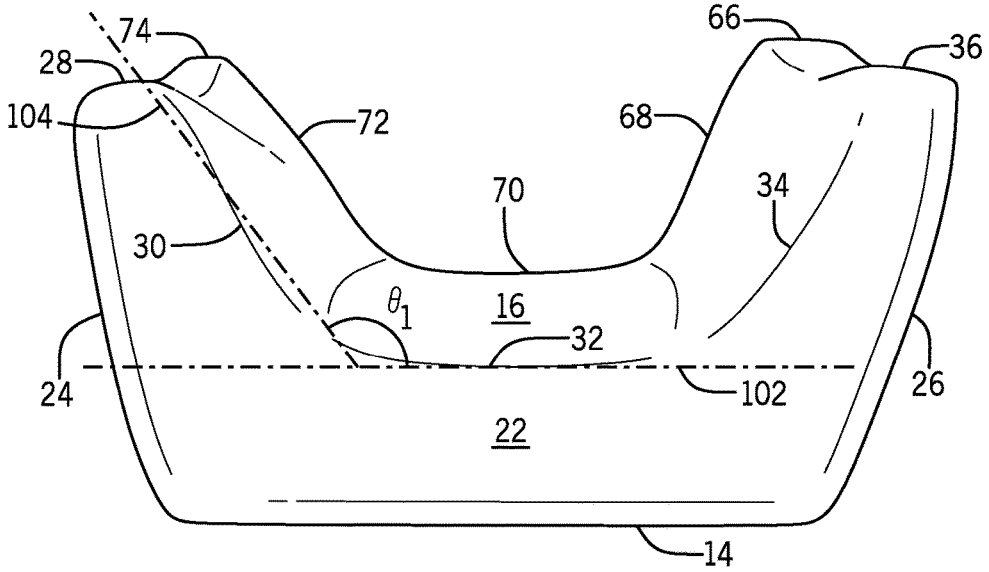
FIG. 2 shows a first side view of one embodiment of the present invention.
Figure 3:
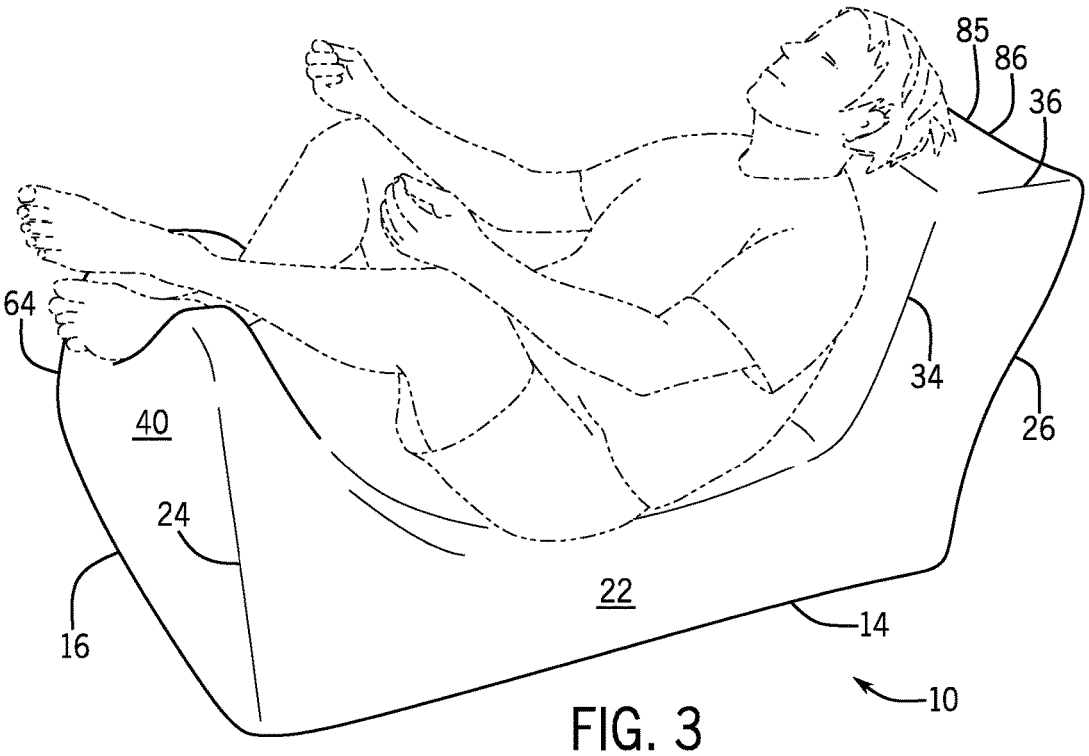
FIG. 3 shows a perspective view of one embodiment of the present invention.
Figure 4:
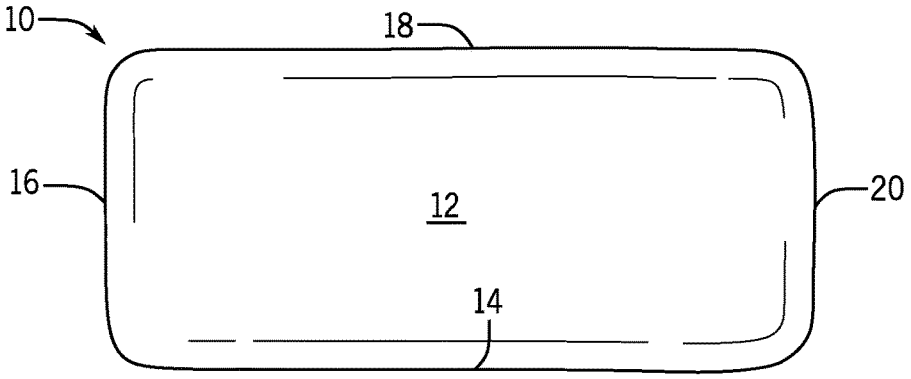
FIG. 4 shows a top view of one embodiment of the present invention.
Figure 5:
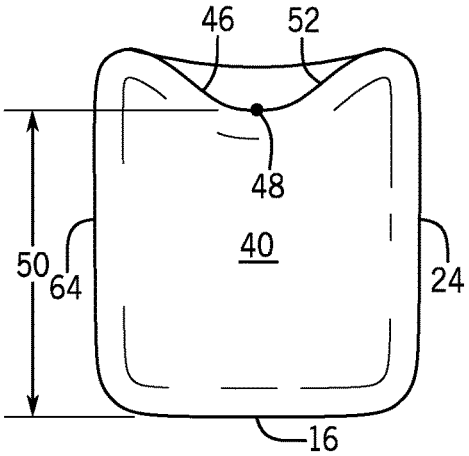
FIG. 5 shows a foot end view of one embodiment of the present invention.
Figure 6:
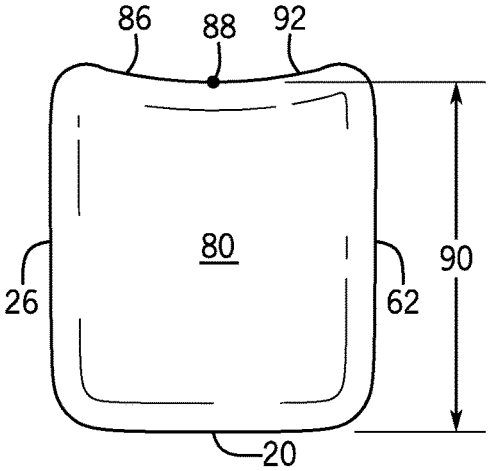
FIG. 6 shows a head end view of one embodiment of the present invention.
Figure 7:
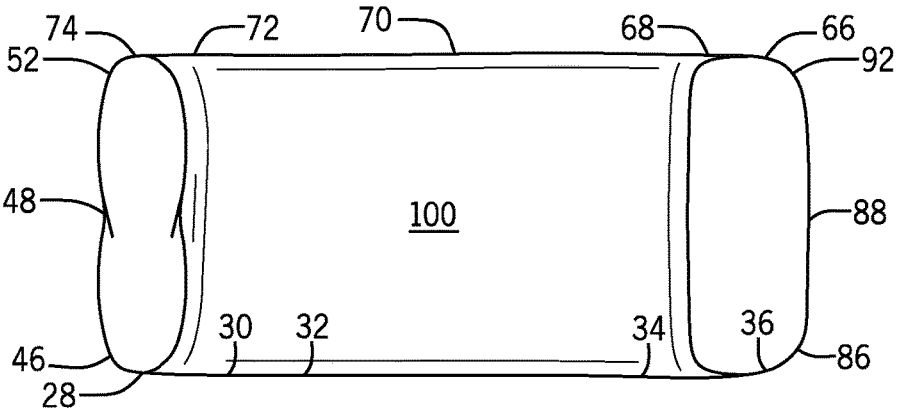
FIG. 7 shows a top view of one embodiment of the present invention.
Figure 8:
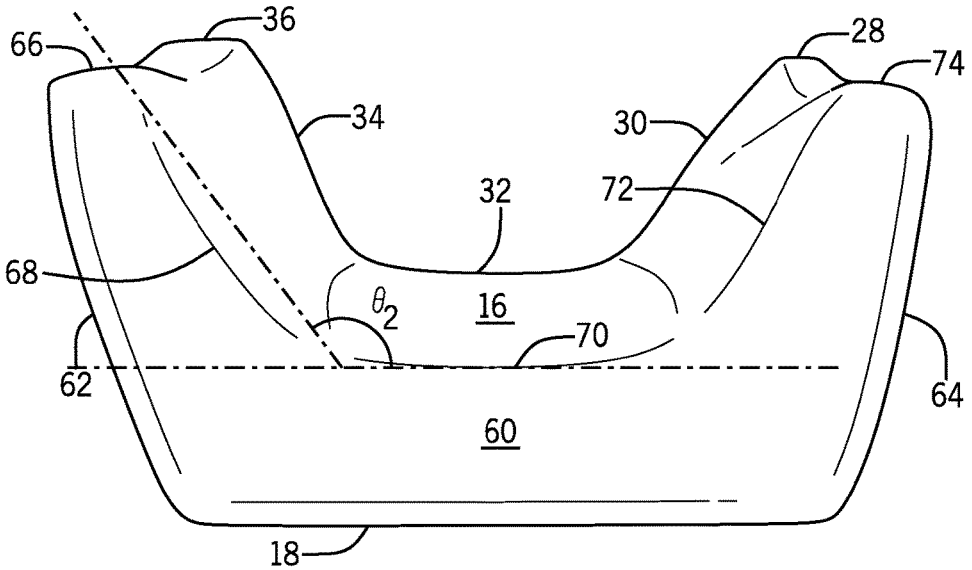
FIG. 8 shows a second side view of one embodiment of the present invention.
Figure 9:
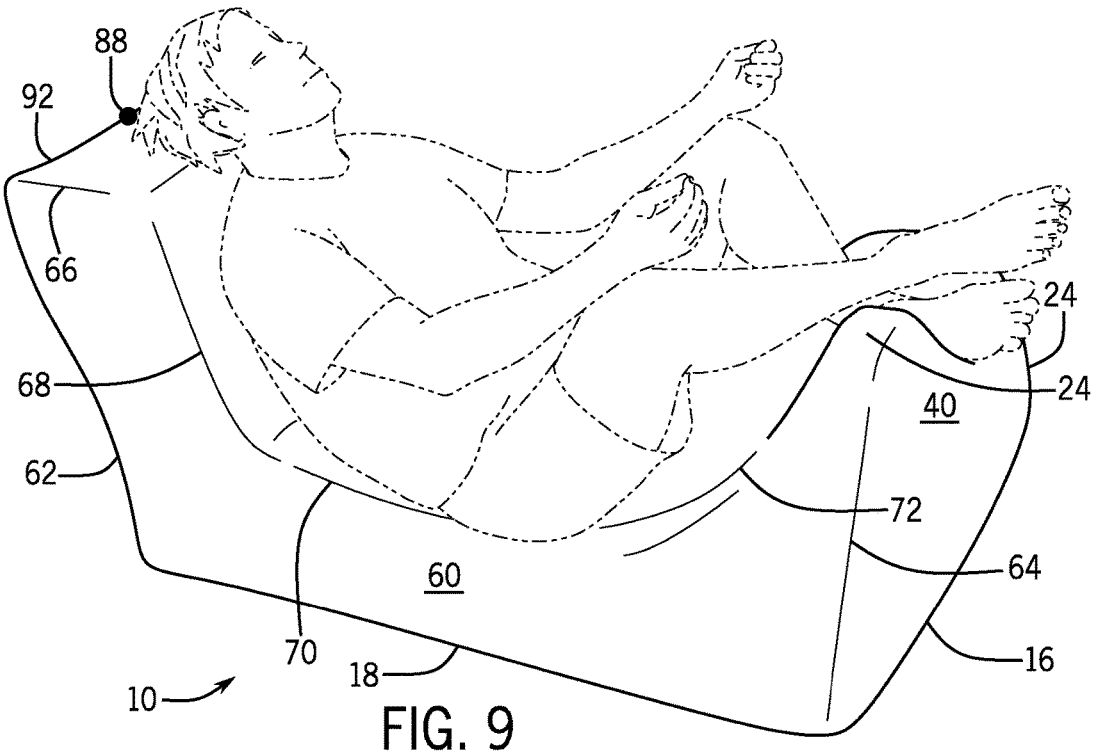
FIG. 9 shows a perspective view of one embodiment of the present invention.

By way of example, and referring to FIGS. 1-9, one embodiment of a contoured mediation seat assembly further comprises a contoured meditation seat 10 that further comprises a base 12 defined by a base first edge 14 joined to base second edge 16. The base second edge 16 is joined to a base third edge 18. The base third edge 18 is joined to a base fourth edge 20. The base 12 is approximately rectangular.

A first side 22 further comprises the base first edge 14 joined to a first side first edge 24 and a first side second edge 26. The first side first edge 24 is joined to a first side first top edge 28. The first side first top edge 28 is joined to a first side third edge 30. The first side third edge 30 is joined to a first side platform edge 32. The first side platform edge 32 is joined to a first side fourth edge 34. The first side fourth edge 34 is joined to a first side second top edge 36. The first side second top edge 36 is joined to the first side second edge 26.

A foot end side 40 further comprises the base second edge 16 joined to the first side first edge 24 and a second side second edge 64. The second side second edge 64 is joined to a foot end first sloping section 46 that terminates at a foot end sloping end point 48 forming a concave footrest portion. The foot end sloping end point 48 is vertically offset from the base second edge 16 by a foot end distance 50. A foot end second sloping section 52 also terminates at the foot end sloping end point 48 and is joined to the first side first edge 24.

A second side 60 further comprises the base third edge 18 joined to a second side first edge 62 and the second side second edge 64. The second side first edge 62 is joined to a second side first top edge 66. The second side first top edge 66 is joined to a second side third edge 68. The second side third edge 68 is joined to a second side platform edge 70. The second side platform edge 70 is joined to a second side fourth edge 72. The second side fourth edge 72 is joined to a second side second top edge 74. The second side second top edge 74 is joined to the second side second edge 64.

A head end side 80 further comprises the base fourth edge 20 joined to the first side second edge 26 and the second side first edge 62. The first side second edge 26 is joined to a head end first sloping section 86 that terminates at a head end sloping end point 88. The head end sloping end point 88 is vertically offset from the base fourth edge 20 by a head end distance 90. A head end second sloping section 92 also terminates at the head end sloping end point 88 and is joined to the second side first edge 62. It follows that the head end distance 90 is no more than 80% of the foot end distance 50.

A platform portion 100 further comprises an outer perimeter defined by the foot end second sloping section 52 joined to the second side second top edge 74. The first side first top edge 28 is joined to the foot end first sloping section 46. The first side second top edge 36 is joined to the head end first sloping section 86. The second side first top edge 66 is joined to the head end second sloping section 92.

The first side platform edge 32 is parallel to and coplanar with a first side platform edge axis 102. The first side third edge 30 is parallel to and coplanar with a first side third edge axis 104. A first angle θ1 is measured counter clockwise from the first side platform edge axis 102 to the first side third edge axis 104.

The second side platform edge 70 is parallel to and coplanar with a second side platform edge axis 106. The second side third edge 68 is parallel to and coplanar with second side third edge axis 108. A second angle θ2 is measured counter clockwise from the second side platform edge axis 106 to the second side third edge axis 108.

In some embodiments, the contoured mediation seat assembly comprises the contoured mediation seat 10 made of foam and covered with an outer liner. In some embodiments, the contoured mediation seat 10 is made of foam and covered with an inner liner and an outer liner. In some embodiments, the contoured mediation seat 10 is made of polystyrene pellets. In some embodiments, the contoured mediation seat 10 is within a liner that is inflated with air.

The first angle θ1 is approximately equal to the second angle θ2. The first angle θ1 and the second angle θ2 can be effective between 100 degrees and 160 degrees. Preferably, the first angle θ1 and the second angle θ2 are between 120 degrees and 140 degrees.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A contoured meditation seat, adapted to elevate feet of a human user while arching a back of the human user; the contoured meditation seat comprising:

a base, joined to a first end side and a second end side;

a head end side, joined to the base, the first end side, and the second end side;

wherein the head end side further comprises:

a head end first sloping section, joined to a first side second edge and terminating at a head end sloping end point;

a head end second sloping section, joined to the second side first edge and terminating at the head end sloping end point;

wherein the head end sloping end point is vertically offset from the base fourth edge by a head end distance;

a foot end side, joined to the base, the first end side, and the second end side;

wherein the foot end side further comprises a concave portion elevated above the head end side; wherein the foot end side further comprises:

a foot end first sloping section, joined to the second side second edge and terminating at a foot end sloping end point;

a foot end second sloping section, joined to a first side first edge and terminating at the foot end sloping end point;

wherein the foot end sloping end point is vertically offset from the base second edge by a foot end distance;

wherein the head end distance is no more than 80% of the foot end distance;

a platform portion, arranged between the first end side, the second end side, the head end side and the foot end side;

wherein the platform portion is adapted to accommodate the human user such that feet of the human user are adjacent to the foot end side and a head of the human user is against the head end side.

2. The contoured meditation seat of claim 1, wherein the base further comprises:

a base first edge joined to base second edge;

a base third edge, joined to the base second edge; and a base fourth edge joined to the base third edge;

wherein the base is approximately rectangular.

3. The contoured meditation seat of claim 2, wherein the first end side further comprises:

a first side first edge and a first side second edge, joined to the base first edge;

a first side first top edge, joined to the first side first edge;

a first side third edge, joined to the first side first top edge;

a first side platform edge, joined to the first side third edge;

a first side fourth edge, joined to the first side platform edge; and a first side second top edge, joined to the first side fourth edge and the first side second edge.

4. The contoured meditation seat of claim 3, wherein the second end side further comprises:

a second side first edge and a second side second edge, joined to the base first edge;

a second side first top edge, joined to the second side first edge;

a second side third edge, joined to the second side first top edge;

a second side platform edge, joined to the second side third edge;

a second side fourth edge, joined to the second side platform edge; and a second side second top edge, joined to the second side fourth edge and the second side second edge.

5. The contoured meditation seat of claim 4, wherein the platform portion further comprises an outer perimeter defined by:

the foot end second sloping section, joined to the second side second top edge;

the first side first top edge, joined to the foot end first sloping section;

the first side second top edge, joined to the head end first sloping section; and the second side first top edge, joined to the head end second sloping section.

6. The contoured meditation seat of claim 5, further comprising:

a first side platform edge axis, parallel to and coplanar with the first side platform edge;

a first side third edge axis, parallel to and coplanar with the first side third edge;

wherein a first angle is measured counter clockwise from the first side platform edge axis to the first side third edge axis;

a second side platform edge axis, parallel to and coplanar with the second side platform edge;

a second side third edge axis, parallel to and coplanar with the second side third edge;

wherein a second angle is measured counter clockwise from the second side platform edge axis to the second side third edge axis.

7. The contoured meditation seat of claim 6, wherein the first angle is approximately equal to the second angle; wherein the first angle and the second angle are both at least 100 degrees and no more than 160 degrees.

8. The contoured meditation seat of claim 6, wherein the first angle is approximately equal to the second angle; wherein the first angle and the second angle are both at least 120 degrees and no more than 140 degrees.

* * * * *